US005427250A

United States Patent [19]

Page et al.

[11] Patent Number: 5,427,250

[45] Date of Patent: Jun. 27, 1995

[54] BARREL SCREEN APPARATUS

[76] Inventors: James H. Page, 1405 Sinclair St., Bottineau, N. Dak. 58318; Robert J. Page, 134 Breezy Hills Cove, Grand Forks, N. Dak. 58201

[21] Appl. No.: 174,711

[22] Filed: Dec. 29, 1993

[51] Int. Cl.[6] ..... B07B 1/18

[52] U.S. Cl. ..... 209/284; 209/299

[58] Field of Search ..... 209/284, 288, 299, 294, 209/385

[56] References Cited

U.S. PATENT DOCUMENTS

| | | | |
|---|---|---|---|
| 1,085,539 | 11/1914 | Bush | 209/284 |
| 1,309,754 | 7/1919 | Dovel | 209/284 |
| 2,001,549 | 5/1935 | Sandy | 209/284 |
| 3,942,644 | 3/1976 | Vissers | 209/683 |
| 4,440,637 | 4/1984 | Smit et al. | 209/257 X |
| 5,248,042 | 9/1993 | Kuhmonen | 209/288 X |

FOREIGN PATENT DOCUMENTS

| | | | |
|---|---|---|---|
| 51565 | 6/1966 | Poland | 209/288 |
| 2196423 | 12/1986 | United Kingdom | 209/420 |
| 2223963 | 4/1990 | United Kingdom | 209/420 |

OTHER PUBLICATIONS

RE-TECH, Inc. Model 720 Portable Trommel Screen advertisement Royer 616 MP advertisement.

Wildcat Trommel Screen Plants Model 6-160, Model RHC-6-160 ad RSTI T-550-d Portable Trommel Screen advertisement.

Combi Screen photo brochure.

*Primary Examiner*—Kenneth W. Noland

*Attorney, Agent, or Firm*—Palmatier, Sjoquist & Helget

[57] ABSTRACT

The present invention is a barrel screen apparatus comprising an elongate, hollow, cylindrical and rotatable barrel screen cage having a receiving end and a discharge end. A hopper is positioned adjacent to the receiving end of the barrel screen cage and has a pair of augers to convey the material and regulate the rate of feed into the feed end of the barrel screen cage. A concave plate is attached to the support frame and positioned directly below and along the length of the barrel screen cage to catch the screened material through the cage. Spiral flighting is attached to the external periphery of the barrel screen cage to convey the material forwardly on the concave plate towards the front of the apparatus where stripper bars, mounted longitudinally on the periphery, push the material off the side of the apparatus. The material accumulates adjacent to a fold-down apron on the side of the apparatus which facilitates pickup by a front-end loader or other means.

25 Claims, 3 Drawing Sheets

BARREL SCREEN APPARATUS

BACKGROUND OF THE INVENTION

This invention relates to a material screening apparatus. More particularly, it relates to a barrel screen apparatus.

Screens are utilized for sorting material by size in various industries including construction, waste disposal, landscaping, and building demolition. Some such screens are substantially planar and screen by oscillating or shaking. Conventional trommel or barrel screens are cylindrical in shape, elongate, open at both ends and rotate. They are operated tilted at an angle from horizontal. The material to be processed is dumped into the higher end and the rotation causes the material to tumble to the lower end with screened or sifted material falling down through the screen and the balance of the material discharged out the lower open end. The screened material either accumulates on the ground below the screen or on a conveyor is positioned to catch the material and convey it out from underneath the apparatus. Trommel screens typically have an axial length of several diameters and thus a conveyor ideally would run lengthwise in order to take advantage of the screening action of the full length of the screen. With a lengthwise orientation of the conveyor, the conveyor must extend outwardly from the front or the rear of the apparatus. In that the front and the rear also are where the material enters the apparatus and exits the apparatus, a material handling problem exists.

One way this problem has been resolved is by allowing sufficient clearance between the rotating trommel screen and the ground and allowing the screened material to buildup on the ground where it is then removed by way of a front-end loader or similar device. This design requires that the entire apparatus be elevated which may be impractical or inconvenient in many situations and also raises the open receiving end making input of material more difficult.

A conveyor may be placed in position at a perpendicular angle extending out from under the trommel or barrel screen, however, this typically would only accept a portion of the material screened, creating the need for additional backup removal of the screened material that does not fall directly onto the conveyor.

An additional consideration in the efficient operation of barrel or trommel screen apparatus is that the feed to the receiving end of the trommel has to be regulated to avoid overloading the apparatus. Direct dumping into the receiving end by a front end loader or similar equipment will often overload the apparatus. A typical means of regulating the input is by way of a conveyor belt, where material is first dumped on a conveyor belt and is then conveyed into the open receiving end of the apparatus. This has a disadvantage in that it requires ancillary equipment and/or extends the required space for the operation.

A conveyor on prior art equipment may be self-contained on the same piece of equipment as the rotating trommel screen with a feed hopper at the distal end of the conveyor. This type of equipment has the disadvantage of greatly extended length, a more limited adjustment capability regarding the tilt from horizontal, and presents maintenance problems with the belt such as excessive wear and puncturing of the conveyor belt by the handling of the unscreened material.

SUMMARY OF THE INVENTION

The present invention is a barrel screen apparatus comprising an elongate, hollow, cylindrical and rotatable barrel screen cage having a receiving end and a discharge end. A hopper is positioned adjacent to the receiving end of the barrel screen cage and has a pair of augers to convey the material and regulate the rate of feed into the feed end of the barrel screen cage. A concave plate is attached to the support frame and positioned directly below and along the length of the barrel screen cage to catch the screened material through the cage. Spiral flighting is attached to the external periphery of the barrel screen cage to convey the material forwardly on the concave plate towards the front of the apparatus where stripper bars, mounted longitudinally on the periphery, push the material off the side of the apparatus. The material accumulates adjacent to a fold-down apron on the side of the apparatus which facilitates pickup by a front-end loader or other means.

An advantage and feature of the invention is that the screened material is deposited in a limited area adjacent and forwardly of the apparatus. This compares to the conventional deposition of the screened material below the trommel screen and along the entire length of the screen.

An advantage and feature of the invention is that the screened material is deposited in a limited area adjacent and forwardly of the apparatus. This compares to the conventional deposition of the screened material below the trommel screen and along the entire length of the screen.

An additional advantage and feature of the apparatus is that it minimizes needed ancillary equipment for operation. Material can be fed into the apparatus by a front-end loader or similar equipment and the discharged material and screened material can be similarly effectively removed by the same piece of equipment. The necessity for the use of additional conveyors is eliminated or minimized. Thus, the expense, the required operating space, maintenance, setup time and the transportation difficulties associated with ancillary conveyors are minimized.

An additional advantage of the device is that the augers in the feed hopper effectively regulate the amount of material fed into the open receiving end of the barrel screen cage.

An additional advantage and feature of the invention is that a regulating means is self-contained within the apparatus. Further, the apparatus is significantly smaller than trommel screen apparatus with self-contained conveyors that regulate the material feed to the screen.

An additional advantage and feature of the present invention is that material can easily be fed into the barrel screen apparatus by way of a shovel front-end loader.

An additional advantage of the equipment is that the barrel screen apparatus may also receive material conventionally by way of a conveyor.

An additional advantage and feature of the invention is that the need to remove screened material from below the trommel screen apparatus has been eliminated.

An additional advantage of the present invention is that a single drive motor rotates the barrel screen cage and drives the augers in the feed hopper.

An additional advantage of the present invention is that the rotation of the barrel screen cage automatically operates the stripper bars and spiral flighting to convey the screened material to the side of the apparatus.

An additional advantage of the apparatus is that it is highly flexible and may be used with or without feed conveyors, with or without a conveyor for the discharge of the screened material, and with or without a conveyor for the discharge of the debris from the discharge end of the screen cage.

An additional advantage of the invention is that the fold-down apron may be easily folded upward for transport or storage mode and lowered in place at the job site.

An additional advantage of the invention is that the rotation rate of the augers with respect to the rotation rate of the barrel screen cage may be adjusted by way of changing the sprockets on the augers and main shaft.

An additional advantage of the present invention is that the rotation rate of the barrel screen cage and augers is variable by adjusting the hydraulic oil flow through the single drive motor.

BRIEF DESCRIPTION OF THE DRAWINGS

FIG. 2 shows a plan view of the apparatus.

DETAILED DESCRIPTION OF THE PREFERRED EMBODIMENTS

Figure 1:
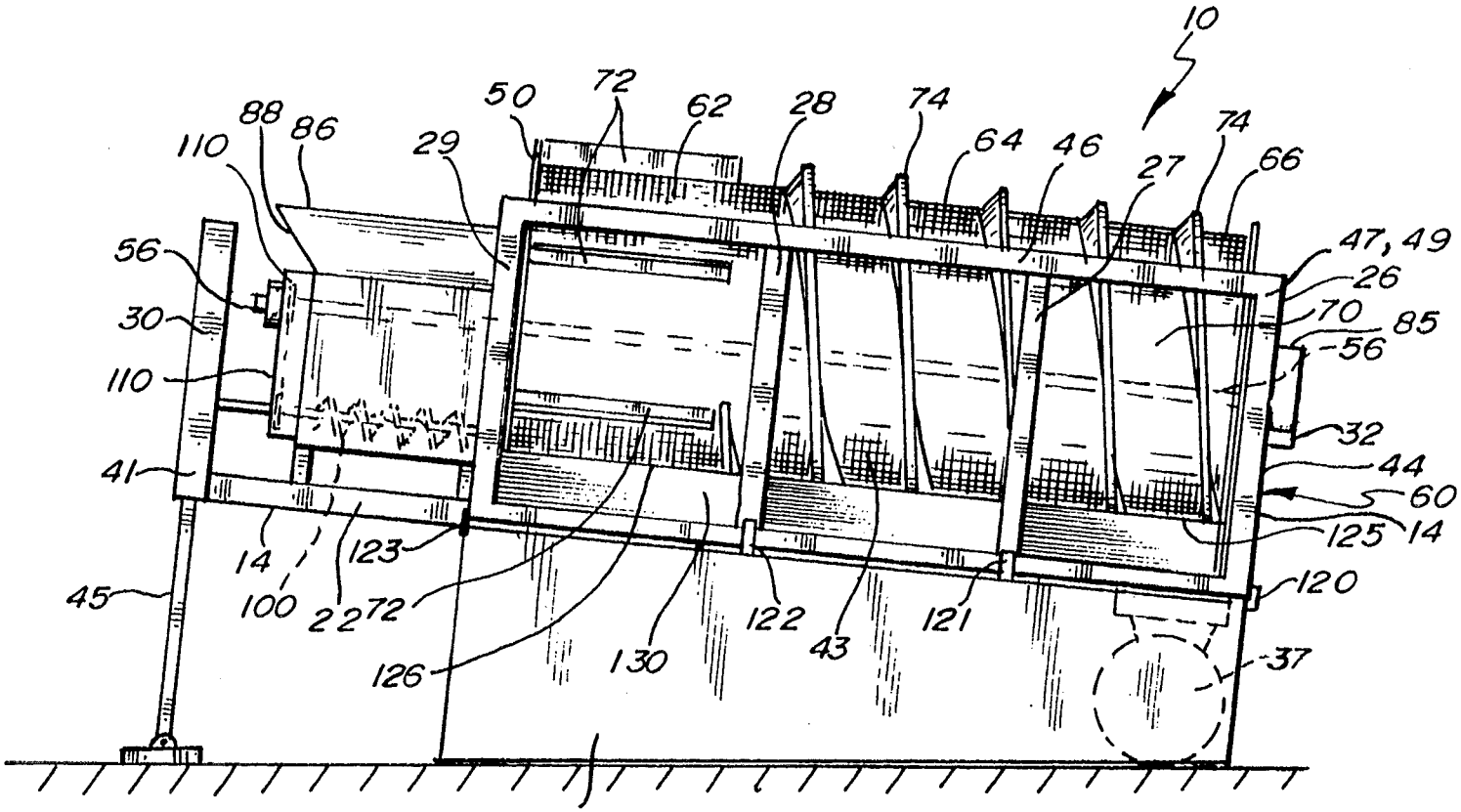
FIG. 1 shows a side elevational view of the apparatus.

Referring to FIG. 1, a side elevational view of an embodiment of the barrel screen apparatus is shown and is generally indicated by the numeral 10. The principal elements of the apparatus generally consist of a support frame 14 supporting a unique barrel screen cage arrangement 46 and concave plate 125 therebelow with a fold-down apron 118. A hopper 86 is also provided.

Referring to FIGS. 1, 2, 3, and 4, the support frame 14 has two main horizontal members 22, 23 extending the length of the apparatus, vertical members 25, 26, 27, 28, 29, 30, 31 and frame cross-members 32, 33, 34, 35, 36. Wheels 37 are conventionally attached to the horizontal members 22, 23 to configure the frame as a trailer. The apparatus may also be skid mounted. The apparatus has a front end 41, a closed side wall 42, an open side 43 and a rear end 44. Extending downward from the front end 41 of the apparatus 10 are jacks 45 for stabilizing and for providing the appropriate tilt for the apparatus 10. The support frame 14 may be conventionally fabricated by welding out of square or rectangular steel tubing.

Figures 3, 6:
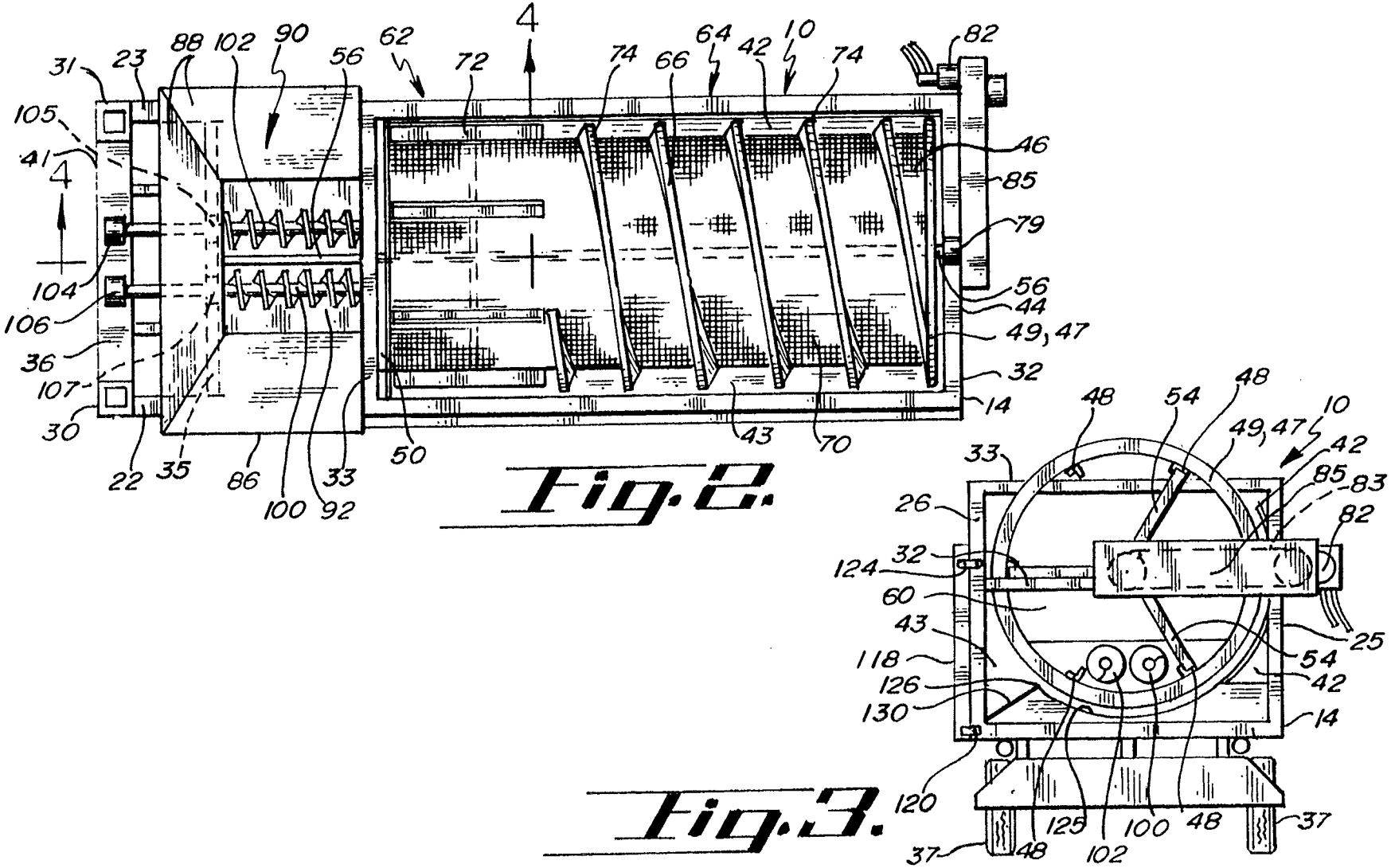
FIG. 3 shows an elevational end view of the apparatus at the discharge end of the barrel screen cage.
Figure 4:
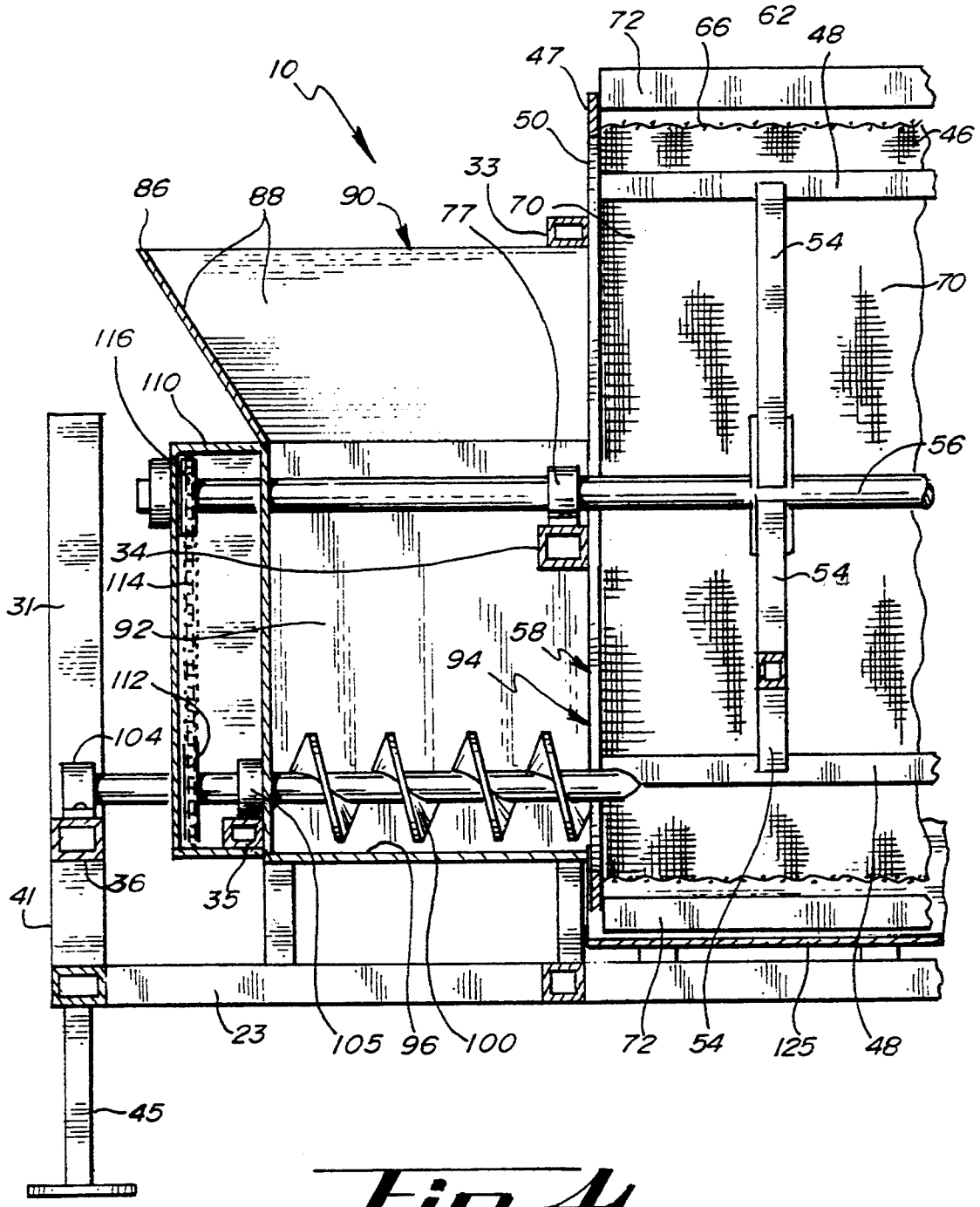
FIG. 4 shows a sectional view taken along line 4—4 of FIG. 2.

Rotatably mounted on the support frame 14 is the hollow and cylindrical barrel screen cage 46 which is shown in various perspectives in FIGS. 1, 2 and 4. The barrel screen cage 46 has a barrel frame 47 comprised of longitudinal angle iron-type members 48 and circumferential ring-like members 49, 50 as best shown in FIGS. 3 and 4. Attached to the barrel frame 47 and extending radially inward are spokes 54 which connect the barrel screen frame 47 to a main shaft 56. The spokes 54 may be fabricated of square tubing and are shown spaced at 120° intervals. The spokes 54 are nonrotatably fixed to the main shaft 56 suitably by welding.

The barrel screen cage 46 has a receiving or feed end 58, best shown in FIG. 4, an open discharge end 60, best shown in FIG. 3, a forward portion 62, a rearward portion 64, and an outer periphery 66, best shown in FIG. 1. In the embodiment shown the forward portion 62 comprises approximately one-third the length of the barrel screen cage 12 and the rearward portion 64 comprises the remaining two-thirds of the length.

The barrel frame 47 is also connected to and supports screen panels 70 which form the periphery 66 of the barrel screen cage 46. The screen panels 70 may be removably attached to the barrel frame 47 by way of bolts or maybe permanently attached such as by welding. The screen panels 70 may be of a wire mesh or apertured sheet metal.

Referring to FIGS. 1 and 2, attached to the outer periphery 66 of the barrel screen cage 46 are stripper bars 72 which run longitudinally on the periphery 66 at the forward portion 62 of the barrel screen cage 46 and extend outwardly. Located on and extending outwardly from the periphery 66 at the rearward portion 64 of the barrel screen cage 46 are helical bars configured as spiral flighting 74. The stripper bars 72 and spiral flighting 74 may be fabricated from steel bar stock and are positioned to sweep, wipe across or move along the concave plate 18. Where the stripper bars 72 or spiral flighting 74 contact the concave plate 18, flexible resilient material, such as hard rubber, may be incorporated in the bars 72 and/or flighting 74.

As best shown in FIG. 2, the barrel screen cage 46 is rotatably mounted to the support frame 14 by way of the main shaft 56 extending through a forward bearing block 77 mounted on forward cross frame member 34 and a rearward bearing block 79 mounted on rearward cross frame member 32. A hydraulic motor 82 is mounted to rearward cross frame member 32 to drive the main shaft 56 by way of a chain and sprocket arrangement 83 under housing 85. A hydraulic pump, which would be an ancillary unit in the preferred embodiment and is not shown, may drive the hydraulic motor 82.

Forwardly mounted on the support frame 14 is the hopper 86 as shown in FIGS. 1, 2 and 4. The hopper 86 has funnel-like upper receiving walls or portion 88 and an open receiving area or material receiving opening 90 into which material is dumped. The hopper 86 further has an interior 92, a discharge area or material discharge opening 94 and a bottom 96. Extending through the lower interior 92 along bottom 96 of the hopper 86 are two augers 100, 102. The augers are mounted by way of bearing blocks 104, 105, 106, 107 fixed to cross frame members 35, 36.

Located at the forward end 41 of the barrel screen apparatus 10 is the housing 110 which is attached to the hopper 86. Referring to FIG. 4, located inside the housing 110 is a sprocket 112 affixed to the auger 102 and similarly a corresponding second sprocket, not shown, is affixed to the other auger 100. The sprockets are linked by a drive chain 114 to a drive sprocket 116 fixed to the main shaft 56.

Referring to FIGS. 1 and 3, the apron 118 is shown in a folded upright position in FIG. 3 and lowered operating position in FIG. 1. The apron 118 folds upwardly and downwardly by way of hinges 120, 121, 122, 123 and is shown trapezoidally shaped to accommodate the tilt of the apparatus during operation. The apron may be secured in upward folded position by latch 124.

Attached to the frame 14 immediately below the barrel screen cage 46 and concentric with the periphery of the barrel screen cage 12 is a concave plate 125. The concave plate 125 extends the length of the barrel screen cage 46 and has an edge 126 extending along the open side 43 of the apparatus substantially the length of the barrel screen cage 12. The edge 126 acts as a discharge edge 126 which is located under the forward portion 62 of the barrel screen cage 12. Extending the length of the concave plate 125 adjacent to the edge 126 is an inclined plate 130 as best shown in FIGS. 1 and 3. The concave plate 125 and inclined plate 130 may be formed of metal plate stock. The concave plate 125 is positioned so that the stripper bars 72 and spiral flighting or helical bar 74 confront the plate 125 whereby the screened material is swept or moved forwardly, and out the open side 43 by the action of the stripper bars 72 and spiral flighting 74. The opposite closed sidewall 42 prevents discharge from the opposite side.

The barrel screen apparatus 10 operates as follows: Referring to FIG. 1, the apparatus is set up on site with an appropriate tilt of the barrel screen cage 46 from horizontal. Jacks 45 fix the apparatus 10 at the appropriate tilt and otherwise stabilize the apparatus 10. The apron 118 is lowered to the operating position. The hydraulic motor 82 is activated by way of the external hydraulic pump and drives the chain and sprocket arrangement 83 behind the housing 85 which rotates the main shaft 56 and correspondingly the barrel screen cage 46. Rotation of the main shaft 56 also rotates the augers 100, 102 by way of the drive chain 114 and sprockets 112, 116 in the housing 110. Rotation of the barrel screen cage 12 also causes the stripper bars 72 and spiral flighting 74 to sweep along the concave plate 125.

Next, the material to be screened is dumped or conveyed into the funnel portion 88 of the hopper 86 whereby the material falls onto and accumulates on the augers 100, 102. The controllable screw motion of the augers 100, 102 evenly pushes the material through the discharge area 94 of the hopper 86 into the feed end 58 of the barrel screen cage 46. The rotation of the barrel screen cage 46 causes the material to tumble and material sized smaller than the screen openings fall downwardly onto the concave plate 125.

Where the screened material falls through the forward portion 62 of the barrel screen cage 46, the stripper bars 72 operate to wipe the concave plate 125 towards the discharge edge 126 of the concave plate 125 where the screened material slides down or falls over the inclined plate 130 and falls downwardly and accumulates in front of the apron 118. With the apron 118 in a lowered position, material is prevented from accumulating underneath the barrel screen apparatus 10 and the apron 118 operates as a push plate which may be utilized by a front end loader or other device to conveniently pickup and move the accumulated material as desired.

As indicated, the rotation and tilt of the barrel screen cage 46 causes the material inside the cage to tumble rearwardly toward the open discharge rear end 60. The material that falls through the screen panels 70 at the rearward portion 64 falls on the concave plate 125 where the auger effect of the spiral flighting 74 pushes this screened material forwardly on the concave plate 125 to the forward portion 62 where it is then laterally wiped off the discharge edge 126 of the concave plate 125 by the stripper bars 72. The material that passes through the length of the barrel screen cage 46 without falling through the screen panels 70 falls rearwardly out the open discharge end 60.

In that the accumulated screened material falls laterally off the open side 43 of the barrel screen apparatus 10, and the unscreened material falls rearwardly from the open discharge end 60, the apparatus 10 may generally be moved without the necessity and difficulty of removing material directly below the apparatus 10 as is the case in a conventional barrel or trommel screen apparatus. This is especially true where the barrel screen apparatus 10 is utilized for screening sludge and similar materials that would be difficult to remove from below the apparatus and present problems with the equipment getting stuck at the screening location. With the open side 43 discharge of the screened material, cleanup of the apparatus 10 following usage is also facilitated.

Conveyors may be used to receive the material pushed over the discharge edge 126 of the concave plate 125 to convey the material as desired. Similarly, a conveyor belt also may be placed under the open discharge end 60 of the barrel screen cage 12 to convey the unscreened material as desired.

It will be noted that the apparatus 10 provides broad flexibility insofar as the usage of ancillary conveyors. If the conveyer equipment is available and convenient, it may be utilized similarly to other trommel screen apparatus, however, where the equipment is not convenient or not available, then the equipment may be efficiently operated without any conveyors whatsoever.

In an alternate embodiment of the invention the stripper bars 72 may extend the entire length of the barrel screen cage 46 without the spiral flighting 74. This will provide a more-or-less even distribution of the screened material along the apron 118.

The drive means for the rotation of the barrel cage 46 is depicted as a hydraulic motor driving the main shaft 56 by way of a chain and sprocket arrangement 83. Alternatively the barrel screen cage 46 may be driven by way of trunnions engaging a circumferential drive rail positioned at the circumferential member 49 attached to or part of the barrel frame 47. This manner of operation is conventional for trommel or barrel screen devices. Similarly, the drive means for the augers 100, 102 may be by way of separate drive motors, i.e., hydraulic, electric, or internal combustion, as opposed to the direct connection to the rotation of the barrel screen cage 46.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A barrel screen apparatus for screening material, comprising:

(a) a transportable open support frame;

(b) a barrel screen cage rotatably mounted to the frame with an open feed end and an open discharge end;

(c) means for adjustably elevating the open feed end of the screen cage with respect to the open discharge end;

(d) a material hopper for receiving material to be screened by the apparatus mounted to the support frame adjacent the open feed end of the barrel screen cage with a material receiving opening and a material discharge opening, the material discharge opening located adjacent the open feed end of the screen cage; and (e) means for controllably feeding the material from the hopper to the screen cage for screening.

2. The apparatus of claim 1, wherein the means for controllably feeding the material from the hopper to the screen cage comprises a rotatable auger in the material hopper extending toward the open feed end of the barrel screen cage.

3. The apparatus of claim 1, further comprising a plate mounted on the frame below the barrel screen cage for catching screened material.

4. The apparatus of claim 3, wherein the plate is concave and concentrically adjacent the barrel screen cage.

5. The apparatus of claim 3, further comprising a stripper bar mounted on a portion of an outer periphery of the barrel screen cage to strip the screened material from the plate and move the screened material away from and to the side of the apparatus.

6. The apparatus of claim 5, wherein the plate is concave.

7. The apparatus of claim 5, further comprising an apron mounted on the frame and positionable adjacent an open side of the apparatus to prohibit the screened material from falling and being pushed below the apparatus.

8. The apparatus of claim 3, further comprising a spiral flighting bar mounted on a rearward portion of an outer periphery of the barrel screen cage to move the screened material on the plate in a direction from the open discharge end toward the open feed end.

9. The apparatus of claim 8, wherein the plate is concave.

10. The apparatus of claim 8, further comprising a stripper bar mounted on a forward portion of the outer periphery of the barrel screen cage to strip the screened material from the plate and move the screen material away from the apparatus.

11. The apparatus of claim 10, further comprising an apron mounted on the frame and positionable adjacent an open side of the apparatus to prohibit the screened material from falling and being pushed below the apparatus.

12. A barrel screen apparatus for screening material comprising:

(a) a support frame;

(b) a barrel screen cage rotatably mounted to the frame with an open feed end and an open discharge end;

(c) means for elevating the open feed end of the screen cage with respect to the open discharge end;

(d) a plate mounted on the frame below the barrel screen cage for catching screen material, wherein the plate is concave and concentric with the barrel screen cage; and (e) a bar mounted on at least a portion of an outer periphery of the barrel screen cage to move the screened material along and from the plate.

13. The apparatus of claim 12, further comprising a material hopper for receiving material to be screened to the apparatus mounted to the support frame adjacent the open feed end of the barrel screen cage with a material receiving opening and a material discharge opening, the material discharge opening located adjacent the open feed end of the screen cage and means for elevating the open feed end of the screen cage with respect to the open discharge end.

14. The apparatus of claim 13, wherein the means for controllably feeding the material from the hopper to the screen cage comprises a rotatable auger in the material hopper extending toward the open feed end of the barrel screen cage.

15. The apparatus of claim 12, wherein the bar comprises a stripper bar to strip the screened material from the plate and move the screened material away from the apparatus.

16. The apparatus of claim 15, further comprising an apron mounted on the frame and positionable adjacent an open side of the apparatus to prohibit the screened material from falling and being pushed below the apparatus.

17. The apparatus of claim 12, wherein the bar comprises a spiral flighting bar mounted on a rearward portion of an outer periphery of the barrel screen cage to move the screened material on the plate in a direction from the open discharge end toward the open feed end.

18. The apparatus of claim 17, further comprising an additional stripper bar mounted on a forward portion of the outer periphery of the barrel screen cage to strip the screened material from the plate and move the screen material away from the apparatus.

19. A barrel screen apparatus for screening material comprising:

(a) a support frame;

(b) a barrel screen cage rotatably mounted to the frame with an open feed end and an open discharge end;

(c) means for elevating the open feed end of the screen cage with respect to the open discharge end;

(d) a plate mounted on the frame below the barrel screen cage for catching screen material;

(e) a bar mounted on a portion of an outer periphery of the barrel screen cage to move the screened material along and from the plate; and (f) an apron mounted on the frame and positionable adjacent an open side of the apparatus to prohibit the screened material from falling and being pushed below the apparatus.

20. The apparatus of claim 19, further comprising a material hopper for receiving material to be screened to the apparatus mounted to the support frame adjacent the open feed end of the barrel screen cage with a material receiving opening and a material discharge opening, the material discharge opening located adjacent the open feed end of the screen cage, and means for controllably feeding the material from the hopper to the screen cage for screening.

21. The apparatus of claim 19, wherein the plate is concave and concentric with the barrel screen cage.

22. The apparatus of claim 19, wherein the bar comprises a stripper bar to strip the screened material from the plate and move the screened material away from the apparatus.

23. The apparatus of claim 19, wherein the bar comprises a spiral flighting bar mounted on a rearward portion of an outer periphery of the barrel screen cage to move the screened material on the plate in a direction from the open discharge end toward the open feed end.

24. The apparatus of claim 23, further comprising an additional stripper bar mounted on a forward portion of the outer periphery of the barrel screen cage to strip the screened material from the plate and move the screen material away from the apparatus.

25. A barrel screen apparatus for screening material, comprising:

(a) a transportable support frame;

(b) a barrel screen cage rotatably mounted to the frame with an open feed end and an open discharge end;

(c) means for adjustably elevating the open feed end of the screen cage with respect to the open discharge end;

(d) a material hopper for receiving material to be screened by the apparatus mounted to the support frame adjacent the open feed end of the barrel screen cage with a material receiving opening and a material discharge opening, the material discharge opening located adjacent the open feed end of the screen cage;

(e) means for controllably feeding the material from the hopper to the screen cage for screening;

(f) a plate mounted on the frame below the barrel screen cage for catching screen material;

(g) a bar mounted on a portion of an outer periphery of the barrel screen cage to move the screened material along and from the plate; and (h) an apron mounted on the frame and positionable adjacent an open side of the apparatus to prohibit the screened material from falling and being pushed below the apparatus.

* * * * *